US009921529B2

(12) United States Patent
Lee

(10) Patent No.: US 9,921,529 B2
(45) Date of Patent: Mar. 20, 2018

(54) METHOD OF CONTROLLING FUSER WITH FUSER CONTROLLER AND MAIN CONTROLLER AND IMAGE FORMING APPARATUS INCLUDING THE FUSER CONTROLLER AND THE MAIN CONTROLLER

(71) Applicant: S-PRINTING SOLUTION CO., LTD, Suwon-si, Gyeonggi-do (KR)

(72) Inventor: Chong-wan Lee, Anyang (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/176,560

(22) Filed: Jun. 8, 2016

(65) Prior Publication Data

US 2017/0199485 A1 Jul. 13, 2017

(30) Foreign Application Priority Data

Jan. 13, 2016 (KR) ..... 10-2016-0004122

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
USPC ..... 399/67
See application file for complete search history.

(56) References Cited

U.S. PATENT DOCUMENTS 5,946,526 A * 8/1999 Kim ..... G03G 15/2003 399/320
8,051,637 B2 11/2011 Labrador
8,180,240 B2 5/2012 Cao et al.
2006/0204251 A1* 9/2006 Ahn ..... G03G 15/50 399/69
2009/0060551 A1* 3/2009 Lee ..... G03G 15/2039 399/70
2012/0261848 A1 10/2012 Haraszati
2013/0156447 A1* 6/2013 Eiki ..... G03G 15/2078 399/33
2014/0105629 A1 4/2014 Ko
2015/0220029 A1* 8/2015 Samei ..... G03G 15/2039 399/69
2016/0065765 A1* 3/2016 Tohki ..... G03G 15/502 358/1.13

* cited by examiner

*Primary Examiner* — Susan Lee
(74) *Attorney, Agent, or Firm* — Staas & Halsey LLP

(57) ABSTRACT

A fuser controller includes a memory configured to store a program, a processor configured to read the program from the memory and to execute the program, a communication unit configured to transmit/receive data to/from the main controller, and an analog-to-digital converter configured to receive an analog signal representing the temperature of the fuser from a thermistor and to convert the analog signal into a digital signal, wherein the processor controls power supplied to a fuser until the main controller completes initialization.

20 Claims, 14 Drawing Sheets

METHOD OF CONTROLLING FUSER WITH FUSER CONTROLLER AND MAIN CONTROLLER AND IMAGE FORMING APPARATUS INCLUDING THE FUSER CONTROLLER AND THE MAIN CONTROLLER

CROSS-REFERENCE TO RELATED APPLICATION

This application claims the priority benefit of Korean Patent Application No. 10-2016-0004122, filed on Jan. 13, 2016, in the Korean Intellectual Property Office, the disclosure of which is incorporated herein in its entirety by reference.

BACKGROUND

1. Field

The present disclosure relates to methods of controlling a fuser and image forming apparatuses.

2. Description of the Related Art

An image forming apparatus prints, copies, scans, etc. The image forming apparatus may include a fuser, and the fuser is heated to high temperature and the heated fuser applies heat to an image.

Since the fuser is controlled by a main controller, when a user turns on power of an image forming apparatus, the main controller of the image forming apparatus starts to operate. The main controller ends preparatory operations for printing and raises the temperature of the fuser up to a target temperature by controlling the fuser.

The main controller controls a fuser, an engine, etc, and obtains a program required for driving the image forming apparatus by reading the program from a memory.

SUMMARY

Provided are methods of controlling a fuser and image forming apparatuses.

Additional aspects will be set forth in part in the description which follows and, in part, will be apparent from the description, or may be learned by practice of the presented embodiments.

According to an aspect of an embodiment, an image forming apparatus includes: a main controller; and a fuser controller, wherein the fuser controller includes: a memory configured to store a program; a processor configured to read the program from the memory and to execute the program; and a communication unit configured to transmit/receive data to/from the main controller, and the processor controls power supplied to a fuser until the main controller completes initialization.

According to an aspect of another embodiment, a method of controlling a fuser of an image forming apparatus includes: applying power to the image forming apparatus; controlling, at a fuser controller, the fuser until a main controller completes initialization; performing, at the main controller, the initialization; and controlling, at the main controller, the fuser.

An image forming apparatus according to an embodiment may include a separate fuser controller and control temperature of a fuser by using the fuser controller.

The fuser controller according to an embodiment may control the temperature of the fuser while the main controller is being booted.

BRIEF DESCRIPTION OF THE DRAWINGS

These and/or other aspects will become apparent and more readily appreciated from the following description of the embodiments, taken in conjunction with the accompanying drawings.

DETAILED DESCRIPTION

Embodiments are described below with reference to accompanying drawings.

Figure 1:
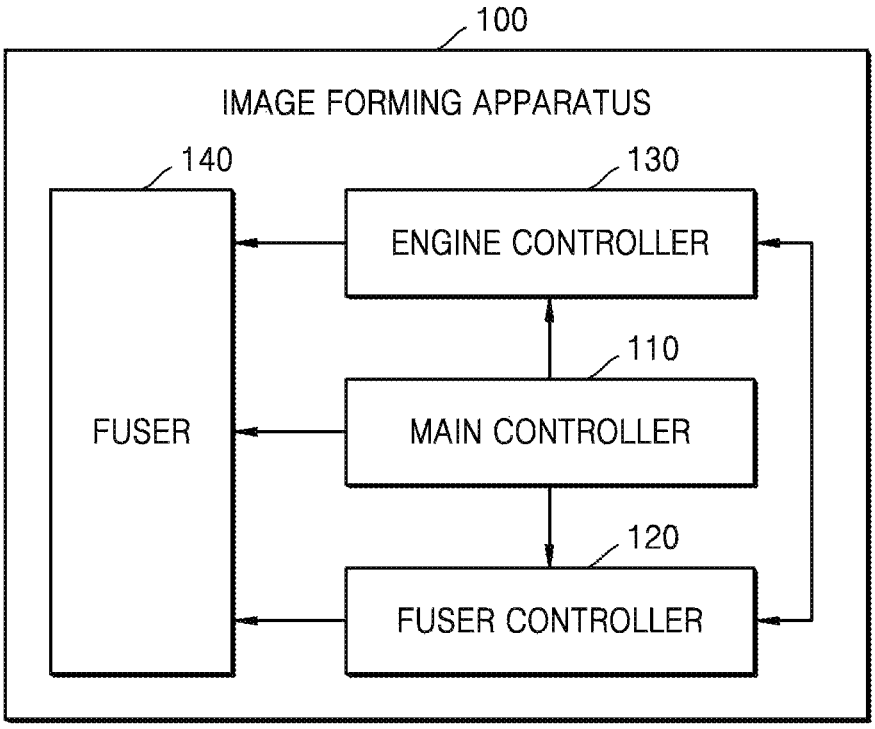
FIG. 1 is a block diagram illustrating an image forming apparatus according to an embodiment.

FIG. 1 is a block diagram illustrating an image forming apparatus 100 according to an embodiment. Referring to FIG. 1, the image forming apparatus 100 includes a main controller 110, a fuser controller 120, an engine controller 130, and a fuser 140. The image forming apparatus 100 may further include a power supply, a roller, a motor, etc., which are omitted in FIG. 1.

The power supply supplies power to the fuser 140. The power supply may be connected to the fuser 140, and a switch may be between the power supply and the fuser 140. The main controller 110, the fuser controller 120, and the engine controller 130 may control power supplied to the fuser 140 by controlling an on/off operation of the switch. In another embodiment, the switch may be included inside the fuser 140 or the power supply.

The image forming apparatus 100 may separately include the fuser controller 120 in addition to the main controller 110. The fuser controller 120 may control the fuser 140 independently of the main controller 110. Specifically, the fuser controller 120 may control the temperature of the fuser 140 by controlling power supplied to the fuser 140, for example, until the main controller 110 completes initialization thereof. The controlling of the temperature of the fuser 140 may be defined as a supplying or a blocking of power to the fuser 140 by controlling an on/off operation of the switch. The controlling of the temperature of the fuser 140 may be defined as a controlling of the temperature of a heat-emitting device such as a lamp included in the fuser 140. The fuser 140 and the power supply may be connected with each other via the switch, and the fuser controller 120 may control an on/off operation of the switch. An exemplary performing at the main controller 110 of the initialization includes reading a booting code stored in a memory, executing the booting code, and initializing a kernel. When the main controller 110 is turned on from an off-state, the main controller 110 starts the initialization thereof. When power is applied to the main controller 110, the power may also applied to the fuser controller 120. When the power is applied to the fuser controller 120, the fuser controller 120 may execute only a program for controlling the fuser 140 and control the fuser 140 faster than the main controller 110. Therefore, the image forming apparatus 100 may reduce the time taken for printing a first page.

Figure 2:
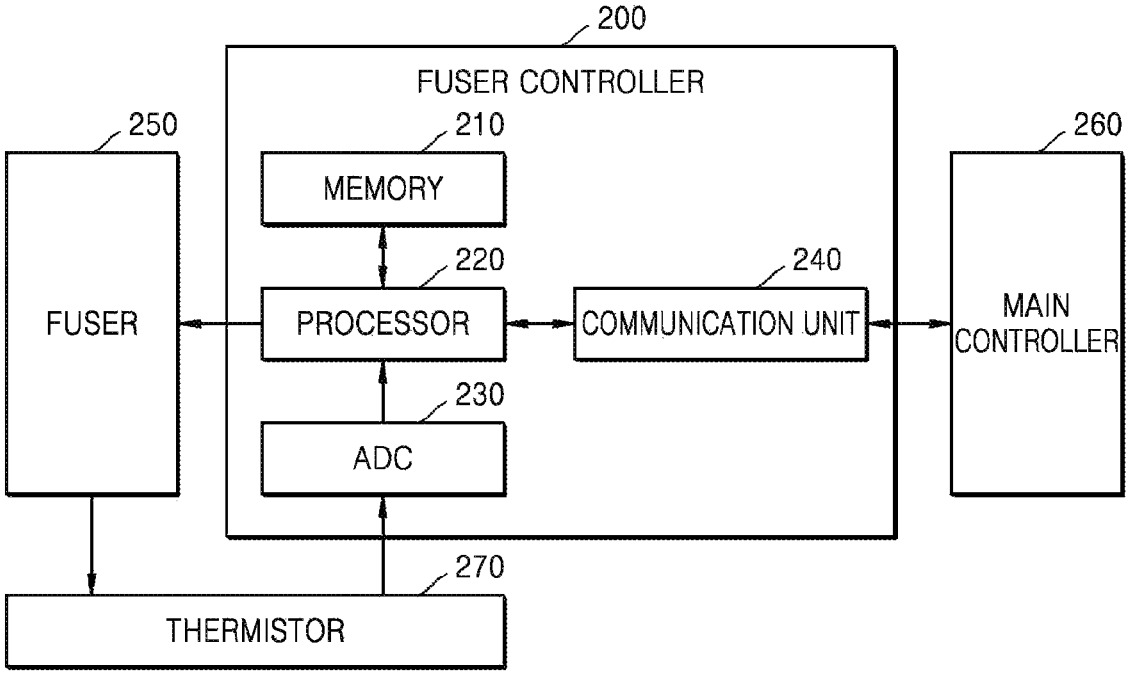
FIG. 2 is a block diagram illustrating a fuser controller according to an embodiment.

FIG. 2 is a block diagram illustrating a fuser controller 200 according to an embodiment. Referring to FIG. 2, the fuser controller 200 includes a memory 210, a processor 220, an analog-to-digital converter (ADC) 230, and a communication unit 240. The fuser controller 200 may control a fuser 250 depending on the temperature of the fuser 250 received from a thermistor 270.

The memory 210 stores a program for operating the fuser controller 200. Since the fuser controller 200 controls only the fuser 250, the memory 210 may store a program as to whether to supply power to the fuser 250 and for a method of supplying power to the fuser 250.

The memory 210 stores a duty table having recorded thereon duty, for example, duty values, corresponding to the life of the fuser 250. The duty represents a ratio of a supply time to a blocking time of the power. If the time for which the fuser 250 is used or a number of times of use of the fuser 250 increases, even when power is supplied to the fuser 250 at the same duty, the temperature of the fuser 250 may change. Therefore, the memory 210 stores a duty table having recorded thereon changes of duty based on a use time or a number of times of use of the fuser 250. For example, the memory 210 may store the duty table in which duty increases as a use time or a number of times of use of the fuser 250 increases. The fuser controller 200 or the engine controller 130 may count a use time or a number of times of use of the fuser 250.

The processor 220 may measure the time taken for which the temperature of the fuser 250 to rise up to a target temperature and store the measured time in the memory 210. The processor 220 may perform a duty control based on the measured time. For example, when a use time or a number of times of use of the fuser 250 increases, the time taken for the fuser 250 to rise up to the target temperature may increase. The processor 220 may shorten the time taken for the fuser 250 to rise up to the target temperature by increasing duty. When the time taken for the fuser 250 to rise up to the target temperature is measured for all sections, a space of the memory 210 may be insufficient. Therefore, the processor 220 may measure and store the time taken for the fuser 250 to rise up to the target temperature when a use time of the fuser 250 exceeds a reference time or a number of times of use exceeds a reference number of times.

The processor 220 reads a program from the memory 210 and executes the program. The processor 220 controls the fuser 250 according to the program.

The processor 220 supplies power to the fuser 250 until a main controller 260 completes initialization thereof. The processor 220 may control power supplied to the fuser 250 by controlling a switch connected between the fuser 250 and the power supply. The fuser 250 may include a lamp, and the fuser controller 200 may control power applied to the lamp. Since the main controller 260 may load a complicated program compared with the fuser controller 200, much time is taken for performing the initialization thereof. Since the fuser controller 200 may load only a program for controlling the fuser 250, the fuser controller 200 may control the fuser 250 faster than the main controller 260.

The processor 220 controls the fuser 250 based on the temperature of the fuser 250 received from the ADC 230. The processor 220 may control power supplied to the fuser 250. Also, the processor 220 may increase or decrease the temperature of the fuser 250 by adjusting a duty of the power supplied to the fuser 250. The duty represents a ratio of a supply time to a blocking time of the power. When the duty increases, the supply time of the power increases further than the blocking time of the power. When the duty decreases, the supply time of the power decreases less than the blocking time of the power. For example, the processor 220 may increase the supply time of the power by increasing an on-time of the switch and decrease the supply time of the power by increasing an off-time of the switch. Since the power supplied to the fuser 250 increases when the duty increases, the temperature of the fuser 250 rises. Since the power supplied to the fuser 250 decreases when the duty decreases, the temperature of the fuser 250 decreases. In the case where the temperature of the fuser 250 is equal to or greater than a target temperature, the processor 220 blocks the power supplied to the fuser 250. The processor 220 may change the target temperature. The processor 220 may change the target temperature based on the state, the life, a number of times of use, etc. of the fuser 250.

The processor 220 determines whether the temperature of the fuser 250 exceeds a reference value and controls the power supply so that the power is supplied to the fuser 250 only if the temperature of the fuser 250 does not exceed the reference value. The reference value may be a numerical value representing temperature. For example, the processor 220 determines whether the temperature of the fuser 250 exceeds the target temperature, and when the temperature of the fuser 250 exceeds the target temperature, blocks the power supplied to the fuser 250. The blocking of the power supplied to the fuser 250 may be defined as a turning off the switch connected between the fuser 250 and the power supply. In other words, the processor 220 may block the power supplied to the fuser 250 by turning off the switch. A reference value set by the fuser controller 200 may be different from a reference value set by the main controller 260. For example, the reference value set by the fuser controller 200 may be less than the reference value set by the main controller 260.

When the main controller 260 completes the initialization, the processor 220 ends the operation thereof. When a time at which the main controller 260 may control the fuser 250 arrives, the fuser controller 200 ends the operation.

The processor 220 controls the temperature of the fuser 250 according to a duty table. The processor 220 determines the duty of the power supplied to the fuser 250 based on the duty table that records the duty depending on a use time or a number of times of use of the fuser 250. The processor 220 controls the power supplied to the fuser 250 according to the determined duty.

The processor 220 increases or decreases the duty of a signal controlling the fuser 250 depending on the temperature of the fuser 250. For example, when the temperature of the fuser 250 exceeds the target temperature, the processor 220 may decrease the duty, and when the temperature of the fuser 250 is less than the reference value, the processor 220 may increase the duty.

When the temperature of the fuser 250 is equal to or greater than a set temperature, the processor 220 blocks the power supplied to the fuser 250. When the image forming apparatus 100 ends the operation thereof and starts the operation thereof again before the temperature of the fuser 250 decreases, the temperature of the fuser 250 may be the set temperature or more. Therefore, in the case where the temperature of the fuser 250 is equal to or greater than the set temperature even when the operation of the image forming apparatus 100 starts, the processor 220 blocks the power supplied to the fuser 250.

In the case where the image forming apparatus 100 operates in a save mode, the processor 220 blocks the power supplied to the fuser 250. The save mode is a mode for performing only a job requested by a user. Therefore, in the case where the user requests a job irrelevant to printing such as scanning a USB memory or adding papers, the power does not need to be supplied to the fuser 250. Therefore, the processor 220 determines whether to supply the power to the fuser 250 depending on whether there is a print command, and maintains an idle mode until a print command is received.

The communication unit 240 transmits/receives data to/from the main controller 260. When completing the initialization thereof, the main controller 260 may end an operation of the fuser controller 200 by outputting a reset signal to the communication unit 240. The fuser controller 200 controls the fuser 250 only until the main controller 260 controls the fuser 250.

The ADC 230 receives an analog signal representing the temperature of the fuser 250 from the thermistor 270 and converts the analog signal into a digital signal. The ADC 230 outputs a digital signal to the processor 220.

Figure 3:
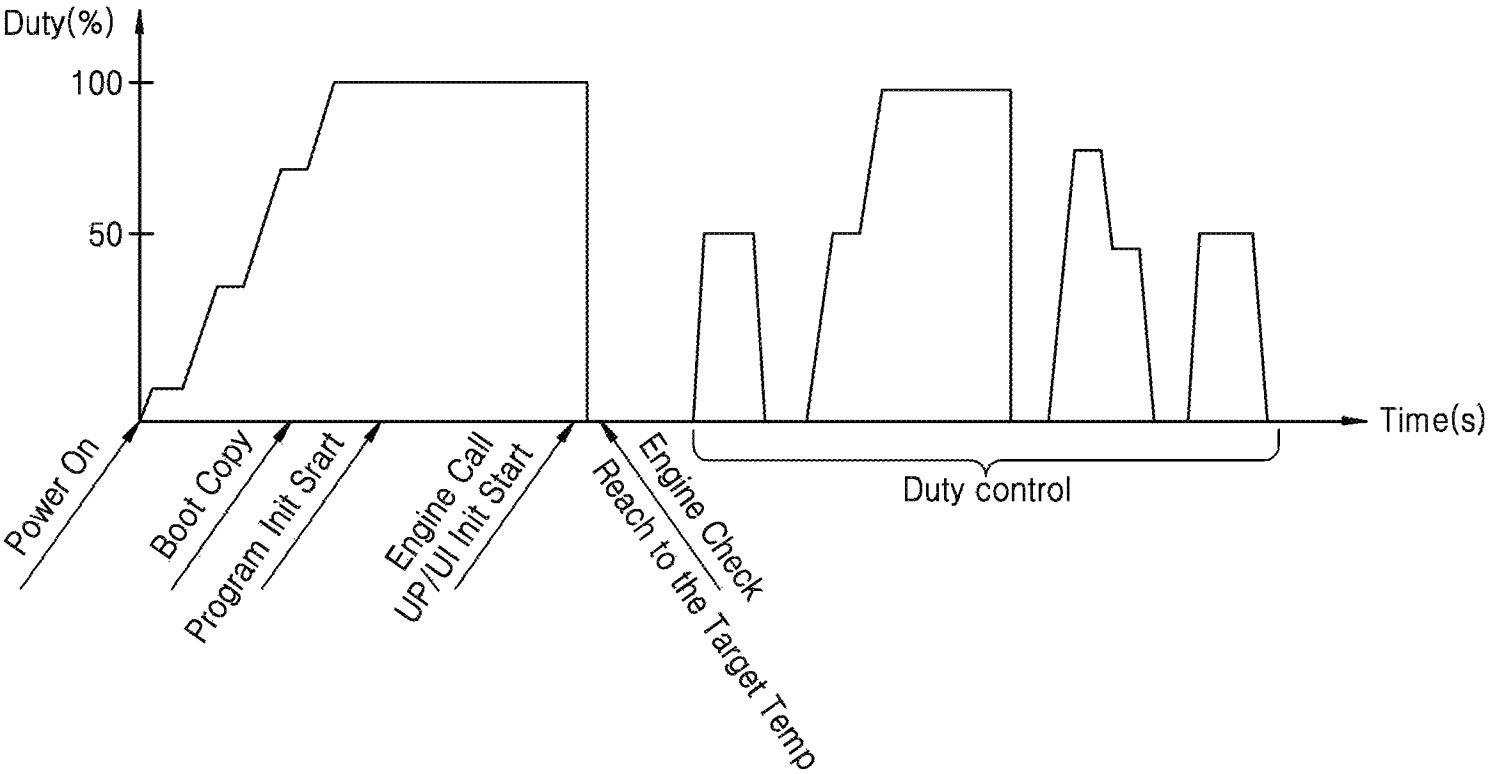
FIG. 3 is a graph for explaining duty control performed by a fuser controller according to an embodiment.

FIG. 3 is a graph for explaining duty control performed by the fuser controller 200 according to an embodiment. When the image forming apparatus 100 starts to operate, the fuser controller 200 starts to supply power to the fuser 250. The fuser controller 200 continues to increase duty until the duty reaches 100% and may gradually increase the duty in order to prevent an abnormal phenomenon such as an inrush current or flicker. For example, the fuser controller 200 may maintain the duty for a predetermined time when the duty is about 10%, 40%, 70%, etc.

When the temperature of the fuser 250 reaches the target temperature, the fuser controller 200 may start duty control of adjusting the time of applying the power to the fuser 250 and the time of not applying the power to the fuser 250.

Figure 4:
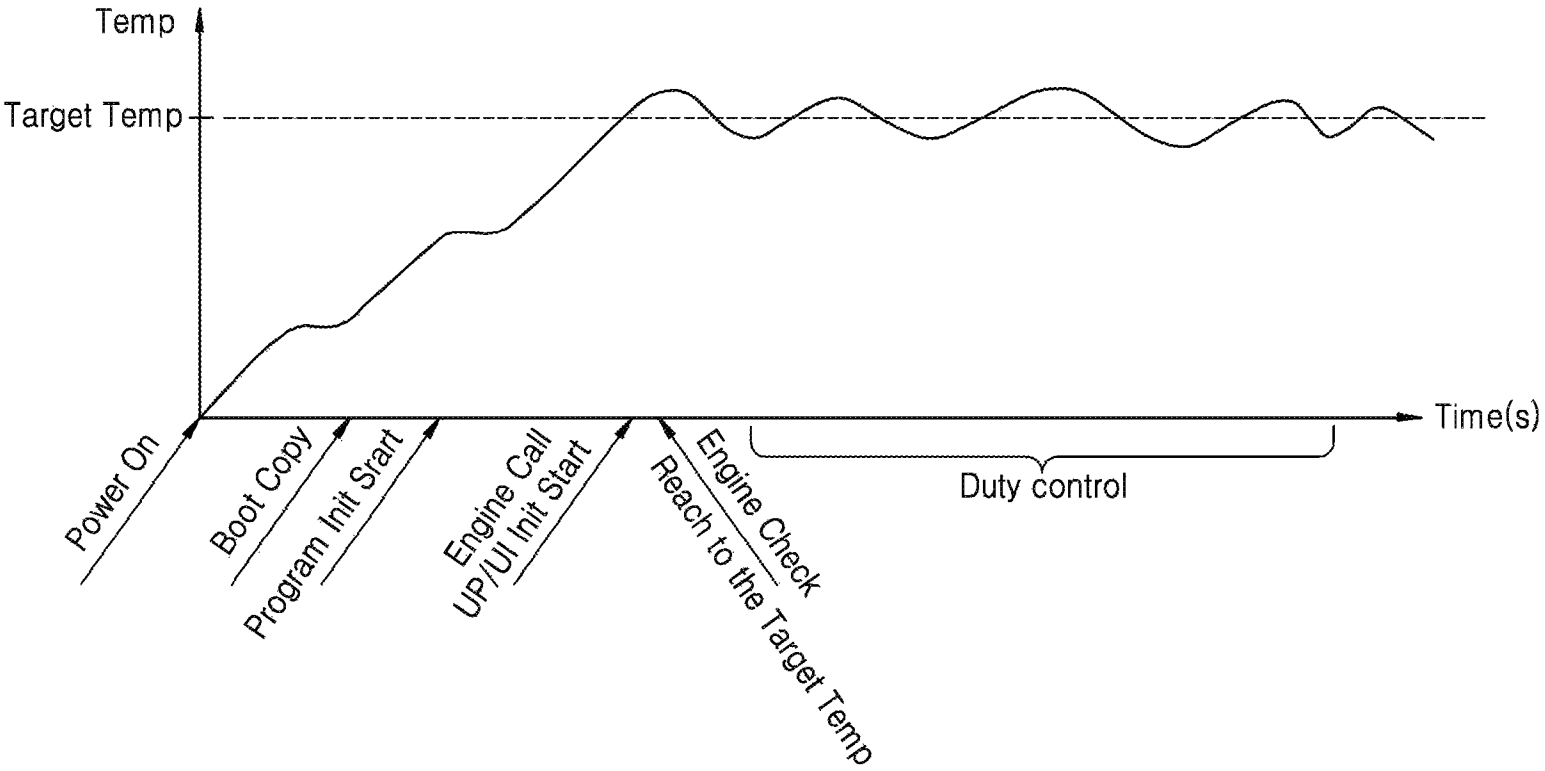
FIG. 4 is a graph for explaining a temperature change of a fuser according to an embodiment.

FIG. 4 is a graph for explaining a temperature change of the fuser 250 according to an embodiment. Referring to FIG. 4, the temperature of the fuser 250 rises up to the target temperature, and then may repeatedly rise and fall around the target temperature. In FIG. 3, during a section in which the fuser controller 200 continues to increase the duty, the temperature of the fuser 250 continues to increase and during a section in which supplying and blocking of the power are repeated, the temperature of the fuser 250 repeatedly rises and falls.

Figure 5:
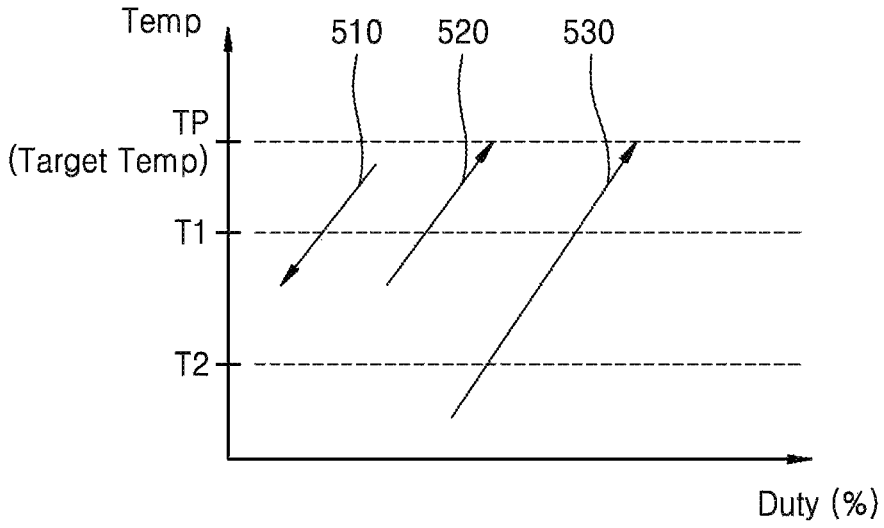
FIG. 5 is a graph for explaining that a fuser controller controls duty depending on temperature of a fuser according to an embodiment.

FIG. 5 is a graph for explaining that the fuser controller 200 controls duty depending on the temperature of the fuser 250 according to an embodiment. When the temperature of the fuser 250 is equal to or greater than the target temperature, the fuser controller 200 blocks the power supplied to the fuser 250.

An arrow 510 represents that in the case where the temperature of the fuser 250 is between TP and T1, the fuser controller 200 decreases the duty.

An arrow 520 represents that in the case where the temperature of the fuser 250 is between T1 and T2, the fuser controller 200 increases the duty.

An arrow 530 represents that in the case where the temperature of the fuser 250 is equal to or less than T2, the fuser controller 200 increases the duty.

Figure 6:
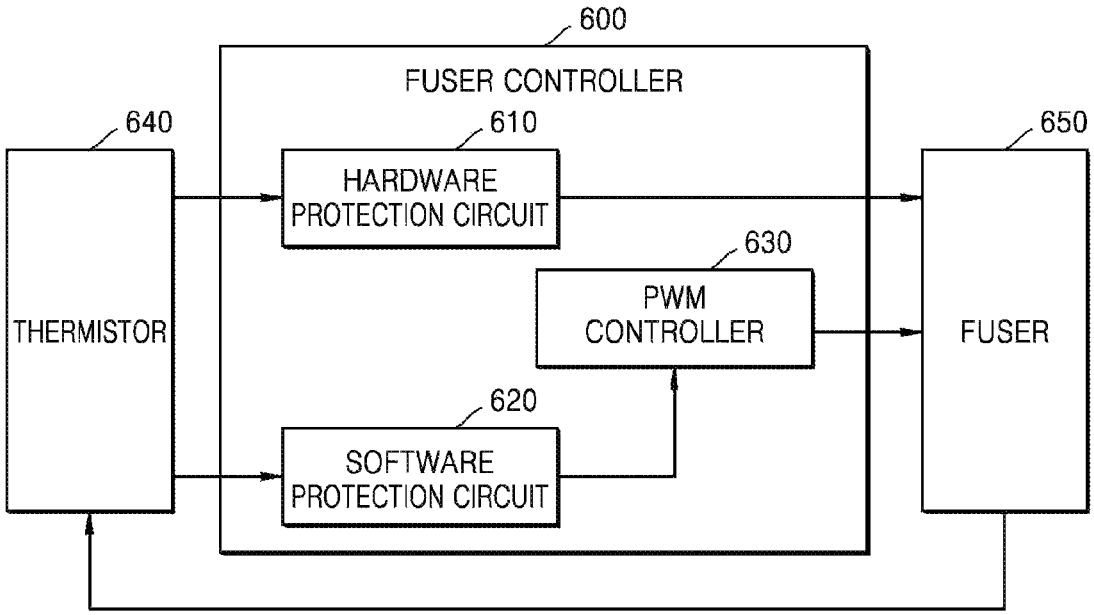
FIG. 6 is a block diagram illustrating a fuser controller according to an embodiment.

FIG. 6 is a block diagram illustrating a fuser controller 600 according to an embodiment. Referring to FIG. 6, the fuser controller 600 may include a hardware protection circuit 610, a software protection circuit 620, and a pulse width modulation (PWM) controller 630.

The hardware protection circuit 610 may control an on/off operation of a fuser 650. The hardware protection circuit 610 may block power supplied to the fuser 650 by controlling a relay included in the fuser 650. The hardware protection circuit 610 controls the on/off operation of the relay of the fuser 650 depending on the temperature of the fuser 650 received from a thermistor 640. For example, in the case where the temperature of the fuser 650 is equal to or greater than a target temperature, the hardware protection circuit 610 blocks power supplied to the fuser 650 by turning off the relay. The hardware protection circuit 610 may include a logic circuit outputting on/off signals to the relay in the case where the temperature of the fuser 650 is equal to or less than a reference value by using a lookup-table. The relay may be connected between the fuser 650 and a power supply.

The software protection circuit 620 may block power supplied to the fuser 650 by controlling a photo coupler included in the fuser 650 via the PWM controller 630. The software protection circuit 620 controls an on/off operation of the photo coupler of the fuser 650 depending on the temperature of the fuser 650 received from the thermistor 640. For example, when the temperature of the fuser 650 is equal to or greater than the target temperature, the software protection circuit 620 blocks the power supplied to the fuser 650 by turning off the photo coupler. The photo coupler may be connected between the fuser 650 and the power supply.

The PWM controller 630 controls the temperature of the fuser 650 by adjusting the width of a pulse applied to the fuser 650. The PWM controller 630 operates only when receiving an on-signal from the software protection circuit 620. The PWM controller 630 may increase the width of a pulse in order to raise the temperature of the fuser 650 and decrease the width of a pulse in order to reduce the temperature of the fuser 650.

The fuser controller 600 may include both the hardware protection circuit 610 and the software protection circuit 620, or include only one of the hardware protection circuit 610 and the software protection circuit 620. In the case where the fuser controller 600 includes both the hardware protection circuit 610 and the software protection circuit 620, the power may be supplied to the fuser 650 only if both the hardware protection circuit 610 and the software protection circuit 620 output an on-signal.

Figure 7:
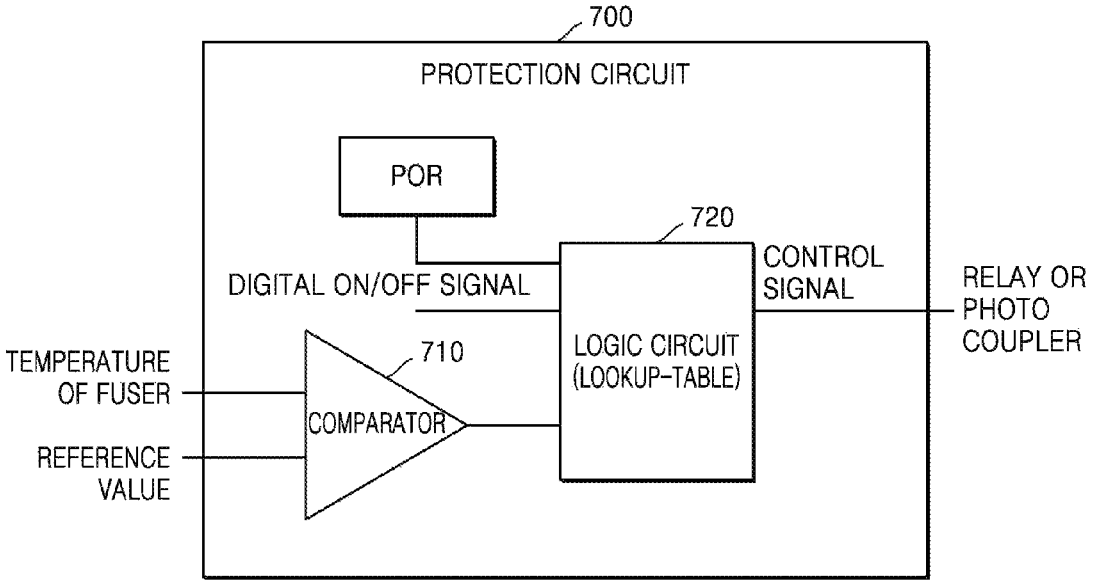
FIG. 7 is a diagram for explaining a protection circuit according to an embodiment.

FIG. 7 is a diagram for explaining a protection circuit 700 according to an embodiment. The protection circuit 700 includes a comparator 710 and a logic circuit 720. The logic circuit 720 may output a control signal to a relay or a photo coupler in response to a signal received from a lookup-table. The lookup-table is a logic table depending on digital signals and defines an output digital signal depending on three input digital signals. For example, the logic circuit 720 may receive a power of rest (POR) signal, a digital on/off signal from the processor 220, and a digital signal from the comparator 710. The POR signal is a digital signal representing whether power is supplied. The digital on/off signal is a signal output by the processor 220. The processor 220 may output an on-signal or an off-signal depending on the temperature of the fuser 650. The comparator 710 compares the temperature of the fuser 650 with a reference value and outputs a digital signal corresponding to the comparison result to the logic circuit 720. For example, the logic circuit 720 may output a control signal operating the relay or the photo coupler only if all of three received digital signals are 0. If any one of the received digital signals is 1, the logic circuit 720 outputs a control signal blocking the relay or the photo coupler.

Figure 8:
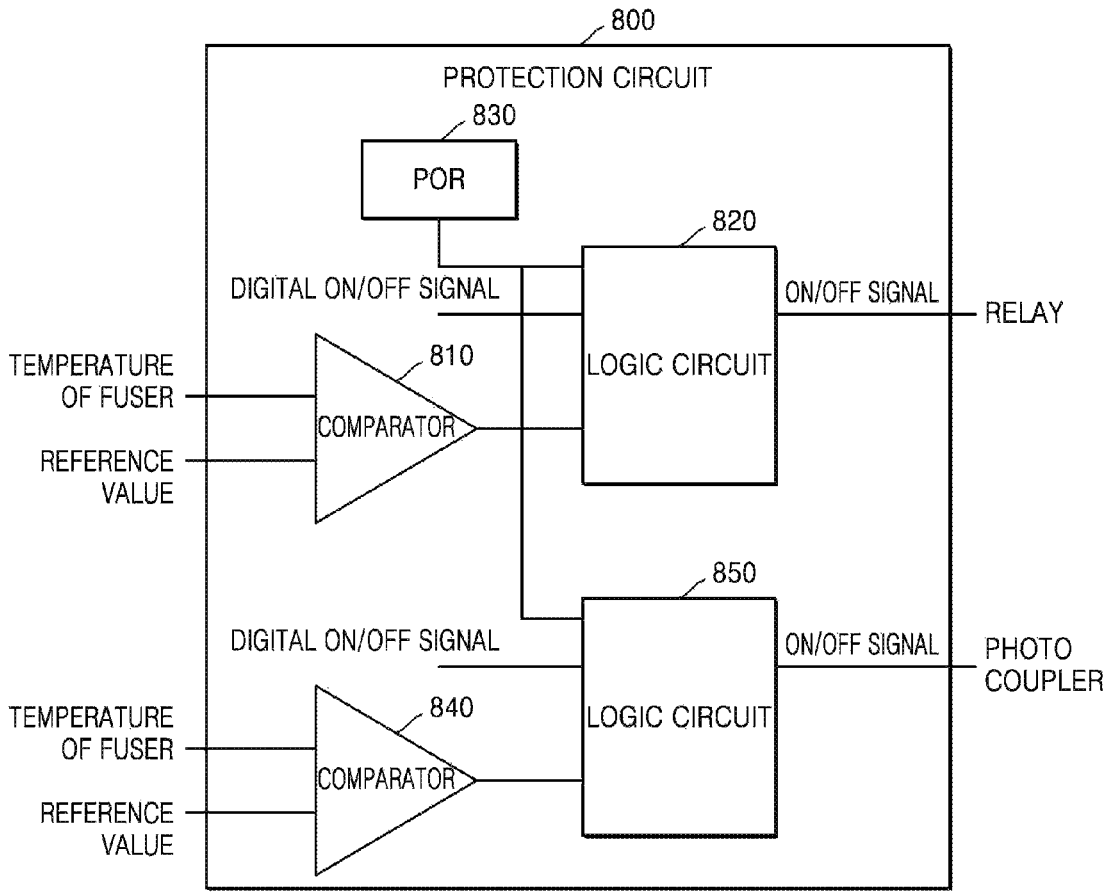
FIG. 8 is a diagram for explaining a protection circuit according to another embodiment.

FIG. 8 is a diagram for explaining a protection circuit 800 according to another embodiment. Referring to FIG. 8, the protection circuit 800 includes two comparators 810 and 840 and two logic circuits, for example, first and second logic circuits 820 and 850. The first logic circuit 820 may output a signal controlling a relay, and the second logic circuit 850 may output a signal controlling a photo coupler.

Figure 9:
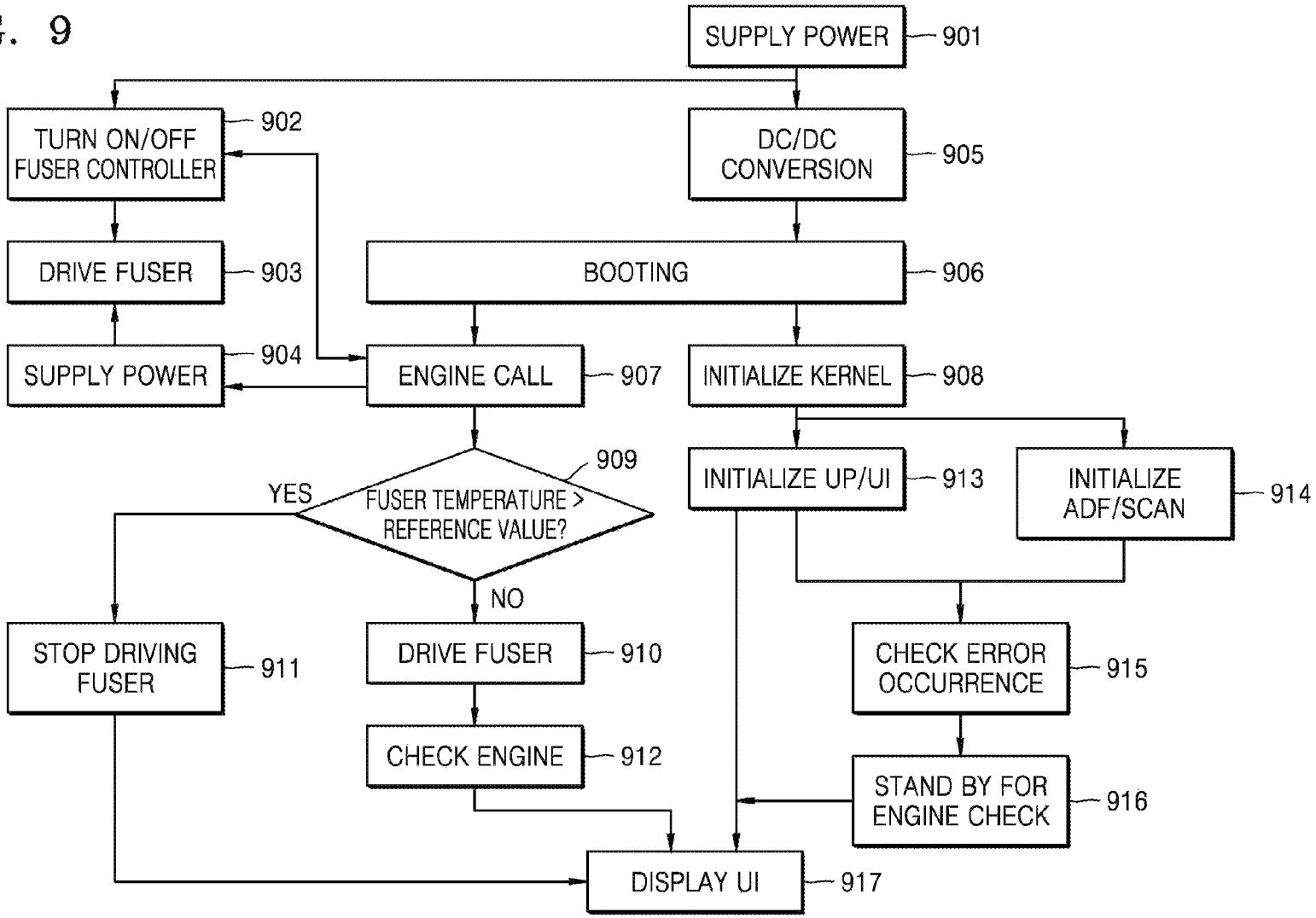
FIG. 9 is a flowchart for explaining a method of controlling a fuser according to an embodiment.

FIG. 9 is a flowchart for explaining a method of controlling a fuser according to an embodiment.

In operation 901, power is supplied to the image forming apparatus 100. AC power may be supplied to the image forming apparatus 100.

In operation 902, when the power is supplied, the fuser controller 200 starts to operate. When receiving a reset signal from the engine controller 130 or the main controller 260, the fuser controller 200 stops the operation thereof. The fuser controller 200 performs initialization and drives the fuser 250.

In operation 903, the fuser controller 200 drives the fuser 250. The fuser controller 200 may drive the fuser 250 even while the main controller 260 is being booted.

In operation 904, the fuser controller 200 controls the power supplied to the fuser 250. The fuser controller 200 raises the temperature of the fuser 250 up to the target temperature. The fuser controller 200 turns on the relay or the photo coupler in order to supply the power to the fuser 250. The fuser controller 200 may prevent an abnormal phenomenon such as an inrush current or a flicker via duty control.

In operation 905, the image forming apparatus 100 converts a direct current (DC) current of a first voltage into a DC current of a second voltage.

In operation 906, the main controller 260 starts booting. The main controller 260 copies a boot code stored in a flash memory to an internal memory. The main controller 260 executes the boot code.

In operation 907, the main controller 260 performs an engine call.

In operation 908, the main controller 260 initializes a kernel.

In operation 909, the main controller 260 determines whether the temperature of the fuser 250 is higher than the reference value. When the temperature of the fuser 250 is higher than the reference value, the main controller 260 performs operation 911, and when the temperature of the fuser 250 is equal to or less than the reference value, the main controller 260 performs operation 910.

In operation 910, the main controller 260 drives the fuser 250.

In operation 911, the main controller 260 stops driving the fuser 250.

In operation 912, the main controller 260 checks an engine.

In operation 913, the main controller 260 initializes UP/UI.

In operation 914, the main controller 260 initializes an automatic document feeder (ADF) and a scanner.

In operation 915, the main controller 260 checks error occurrence.

In operation 916, the main controller 260 stands by in order to check an engine.

In operation 917, the main controller 260 displays a message stating preparation is complete or a message stating an error occurs by displaying a UI.

Figure 10:
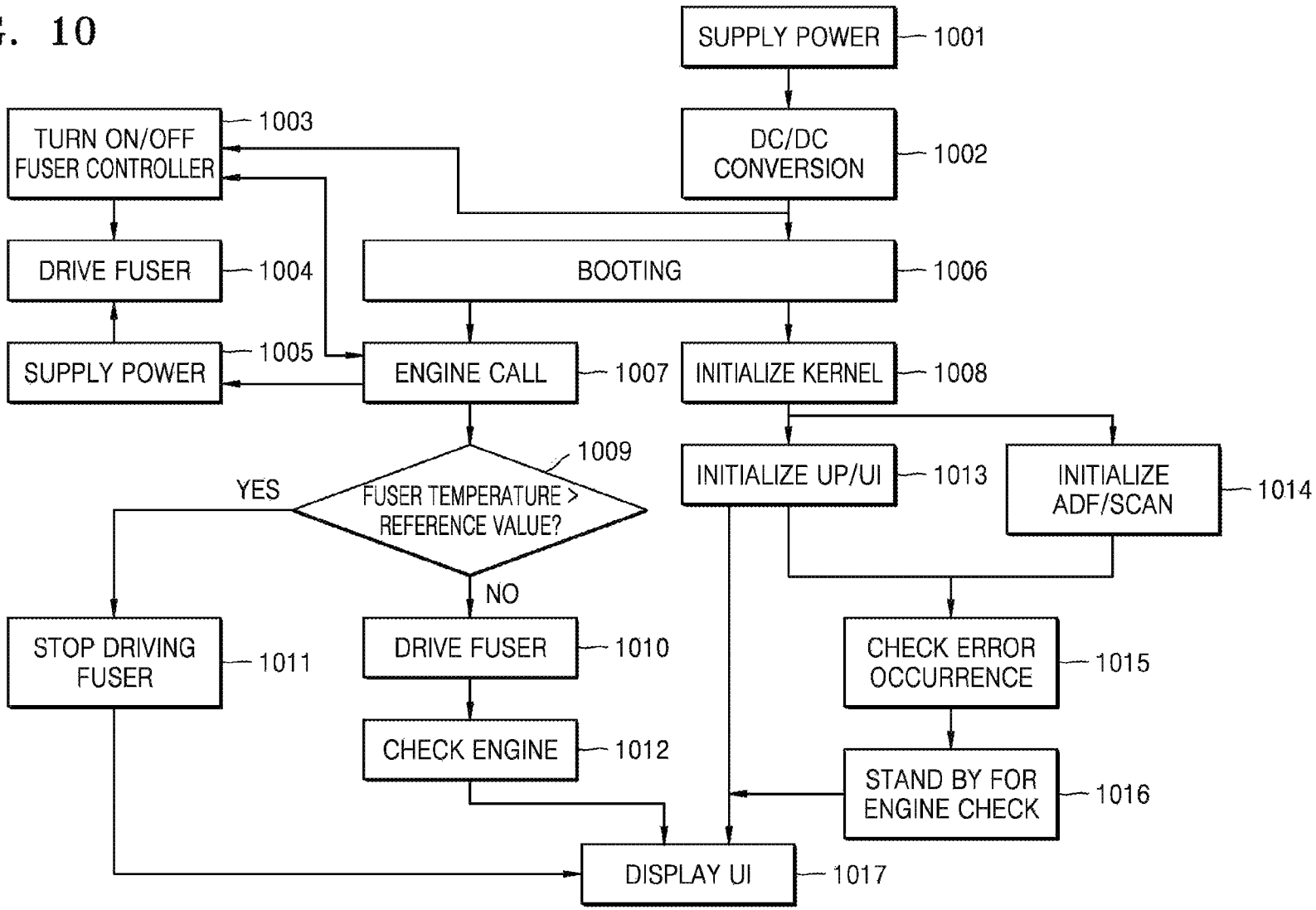
FIG. 10 is a flowchart for explaining a method of controlling a fuser according to an embodiment.

FIG. 10 is a flowchart for explaining a method of controlling a fuser according to an embodiment. In FIG. 10, unlike FIG. 9, the fuser controller 200 operates after operation 1002. Though when the power is supplied to the image forming apparatus 100 in operation 901, the fuser controller 200 starts to operate in FIG. 9, the fuser controller 200 operates after converting a DC current in FIG. 10. Since operations 1004 to 1017 are the same as those in FIG. 9, descriptions thereof are omitted.

Figure 11:
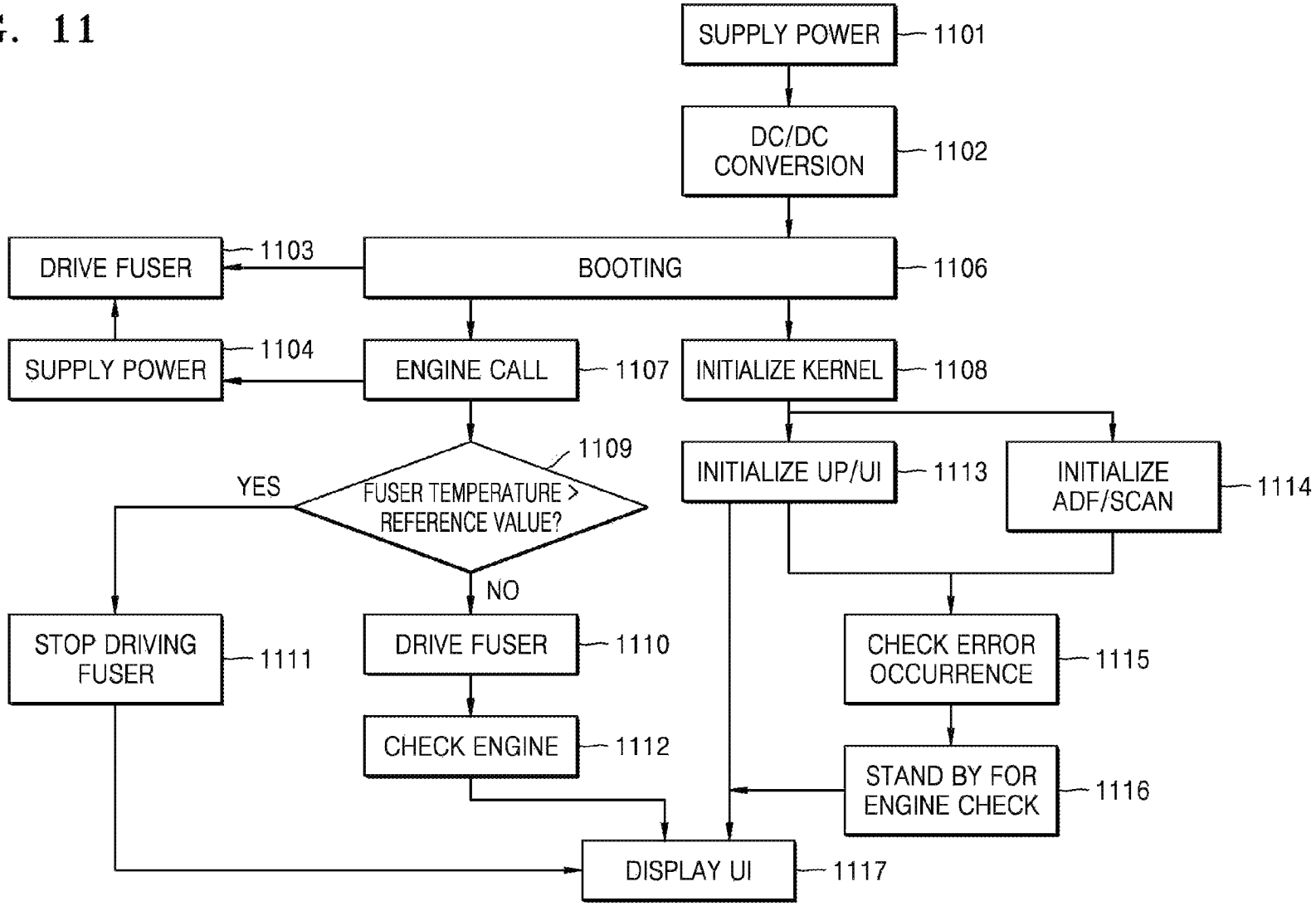
FIG. 11 is a flowchart for explaining a method of controlling a fuser according to an embodiment.

FIG. 11 is a flowchart for explaining a method of controlling a fuser according to an embodiment. FIG. 11 explains a case where the fuser controller 200 is included inside the main controller 260, not a separate circuit. Therefore, unlike FIG. 9 or 10, operation in which the fuser controller 200 operates is omitted. However, since the fuser controller 200 is included inside the main controller 260 and operates, even when the main controller 260 starts booting in operation 1106, the fuser controller 200 may drive the fuser 250.

Since operations 1103 to 1117 are the same as those in FIG. 9, descriptions thereof are omitted.

Figure 12:
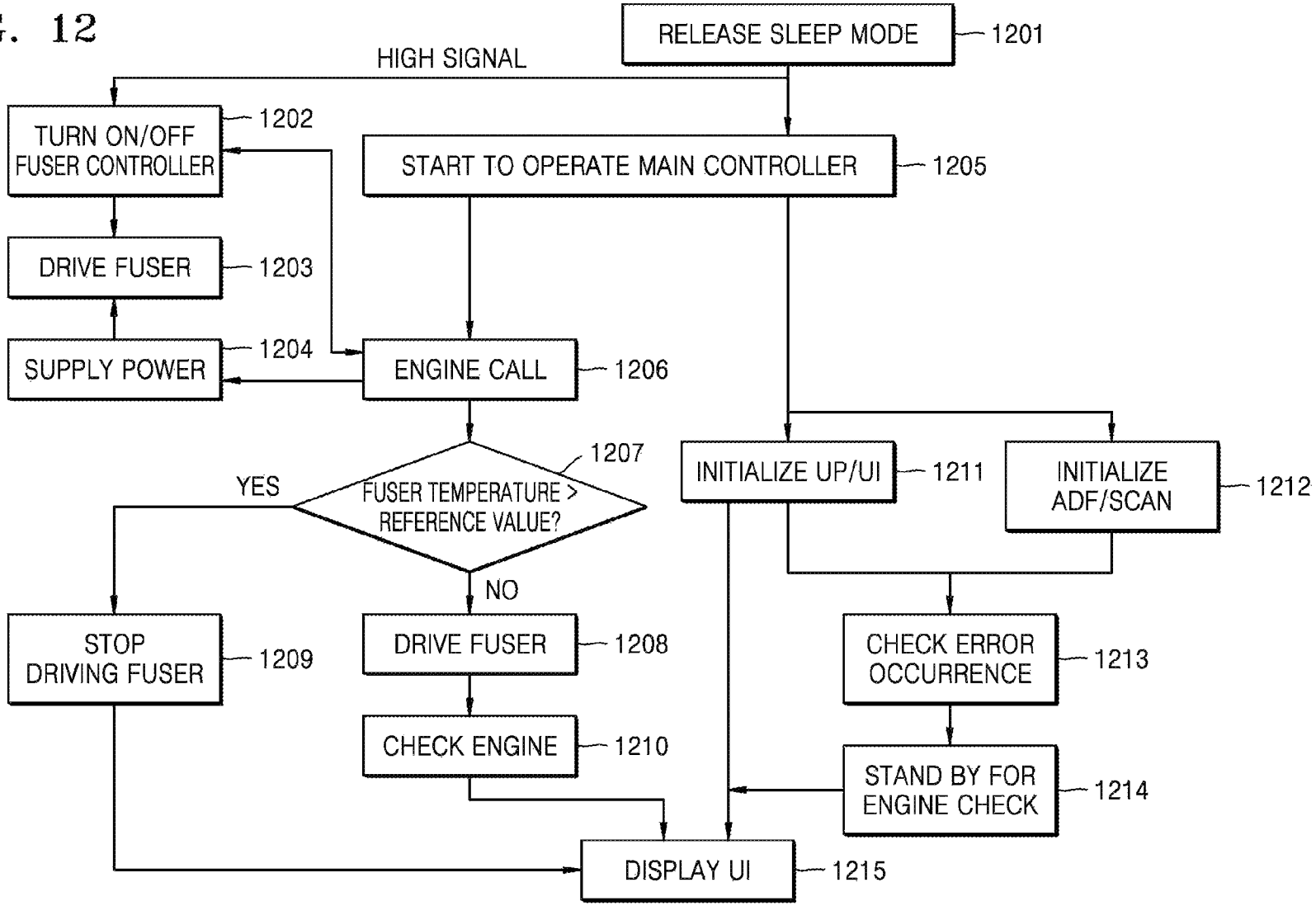
FIG. 12 is a flowchart for explaining a method of controlling a fuser according to an embodiment.

FIG. 12 is a flowchart for explaining a method of controlling a fuser according to an embodiment. FIG. 12 explains a method of controlling the fuser 250 when the image forming apparatus 100 operates in a sleep mode. The sleep mode denotes an idle state consuming only minimum power when a job performed by the image forming apparatus 100 does not exist. For example, the sleep mode may be a state in which the image forming apparatus 100 is allowed to perform only communication with a host device.

In operation 1201, the image forming apparatus 100 releases the sleep mode. For example, in the case of receiving a job command from a user, the image forming apparatus may release the sleep mode.

In operation 1202, when the sleep mode is released, the fuser controller 200 operates. When the sleep mode is released, the main controller 260 outputs a high signal to the fuser controller 200, and when receiving a high signal, the fuser controller 200 starts to operate. The fuser controller 200 may control the fuser 250 before or while the main controller 260 operates. Therefore, the fuser controller 200 may raise the temperature of the fuser 250 up to the target temperature before the main controller 260 controls the fuser 250.

Since operations 1203 to 1215 are the same as those in FIG. 9, descriptions thereof are omitted.

Figure 13:
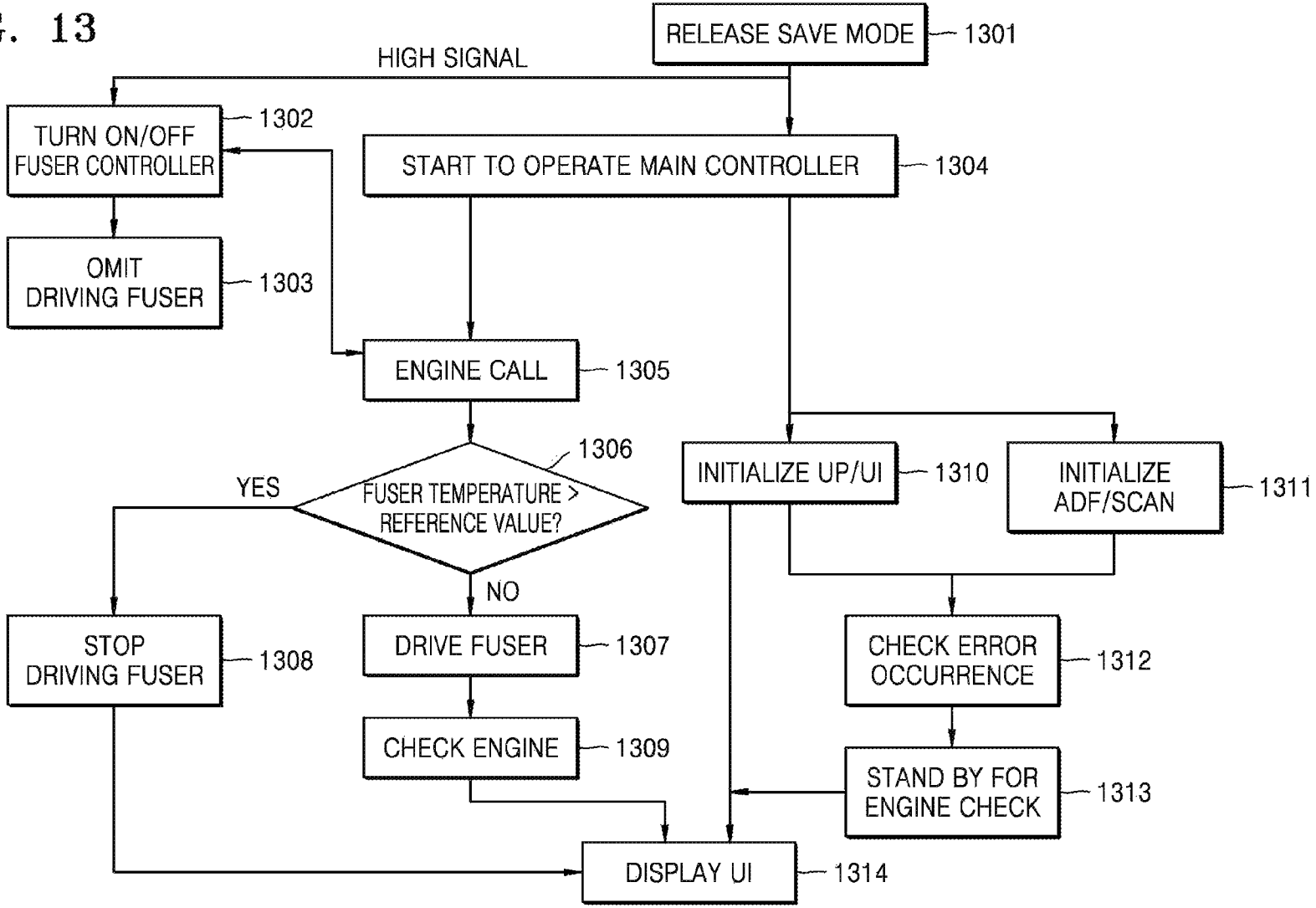
FIG. 13 is a flowchart for explaining a method of controlling a fuser according to an embodiment.

FIG. 13 is a flowchart for explaining a method of controlling a fuser according to an embodiment. FIG. 13 explains a method of controlling the fuser 250 when the image forming apparatus 100 operates in a save mode. The save mode denotes a state in which the image forming apparatus 100 stands by to perform only a request received from a user.

In operation 1301, the image forming apparatus 100 releases the save mode. The save mode is released when a job request is received from a user.

In operation 1302, the fuser controller 200 does not operate because the fuser controller 200 receives a low signal from the main controller 260.

In operation 1303, the fuser 250 is not driven.

In operation 1304, the main controller 260 starts to operate.

Even when the save mode is released, the main controller 260 outputs a low signal to the fuser controller 200. When receiving the low signal, the fuser controller 200 does not start to operate. Since the fuser 250 does not need to be driven in the where a printing request does not exist, the fuser controller 200 does not operate. However, even during the save mode, when receiving a printing request from a user, the fuser controller 200 starts to operate.

Since operations 1305 to 1314 are the same as those in FIG. 9, descriptions thereof are omitted.

Figure 14:
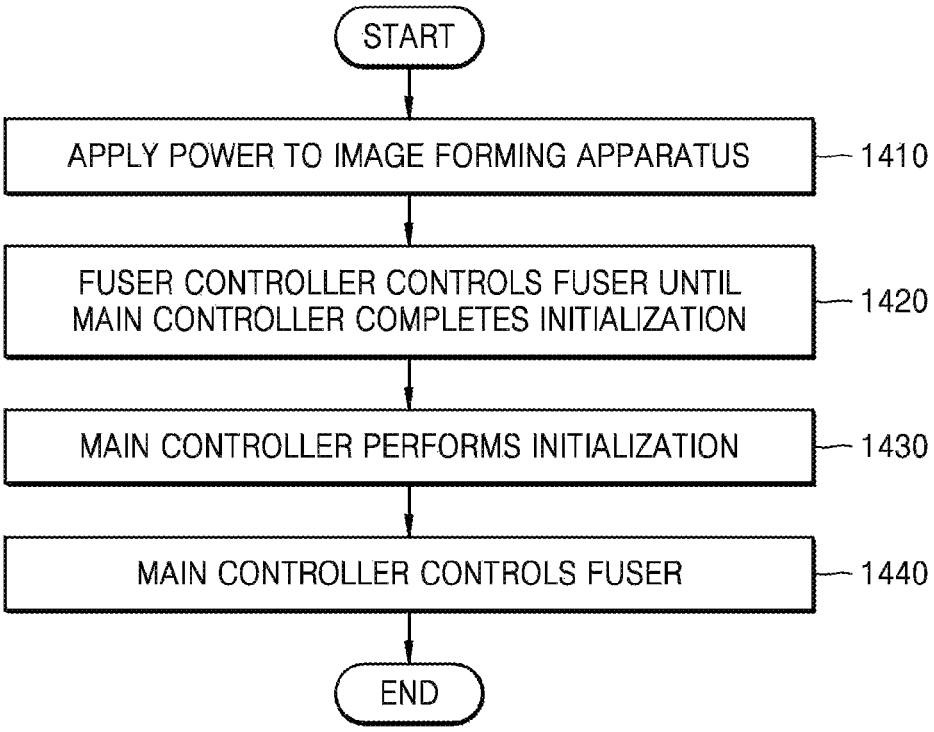
FIG. 14 is a flowchart for explaining a method of controlling a fuser according to an embodiment.

FIG. 14 is a flowchart for explaining a method of controlling a fuser according to an embodiment.

In operation 1410, power is applied to the image forming apparatus 100.

In operation 1420, the fuser controller 200 controls the fuser 250 until the main controller 260 completes initialization. The fuser controller 200 raises the temperature of the fuser 250 to the target temperature. For example, the fuser controller 200 controls the power supplied to the fuser 250 by controlling the relay or the photo coupler.

The fuser controller 200 controls the fuser 250 depending on a mode or a state of the image forming apparatus 100. For example, when the image forming apparatus 100 operates in the sleep mode, the save mode, etc., the fuser controller 200 controls the fuser 250 according to a program stored in a memory of the fuser controller 200. The fuser controller 200 may control the fuser 250 only if a printing request is received from a user.

In operation 1430, the main controller 260 performs initialization. The main controller 260 performs the initialization by using a program stored in the memory. The fuser controller 200 may operate regardless of the initialization of the main controller 260.

In operation 1440, the main controller 260 controls the fuser 250. The main controller 260 completes the initialization, and stops the operation of the fuser controller 200.

Through the above operations, the image forming apparatus 100 may raise the temperature of the fuser 250 to the target temperature in advance before the main controller 260 controls the fuser 250.

An apparatus according to embodiments may include a processor, a memory storing and executing program data, a permanent storage such as a disk drive, a communication port communicating with an external apparatus, a touch panel, and a user interface device such as keys, buttons, etc. Methods implemented as a software module or an algorithm may be stored in a non-transitory computer-readable recording medium as computer-readable codes or program commands executable on the processor. Here, examples of the non-transitory computer-readable recording medium include a magnetic storage medium (for example, read-only memory (ROM), random-access memory (RAM), a floppy disk, a hard disk, etc.) and an optical reading medium (for example, a CD-ROM, a digital versatile disc (DVD)), etc. The non-transitory computer-readable recording medium may be distributed over computer systems connected via a network, and computer-readable codes may be stored and executed in a distributed fashion. The medium may be read by a computer, stored in a memory, and executed by the processor.

The inventive concept may be described in terms of functional block components and various processing operations. Such functional blocks may be realized by a number of hardware and/or software components configured to perform the specified functions. For example, the inventive concept may employ various integrated circuit (IC) components, e.g., memory elements, processing elements, logic elements, look-up tables, and the like, which may carry out a variety of functions under the control of one or more microprocessors or other control devices. Similarly, where the elements of the inventive concept are implemented using software programming or software elements, the inventive concept may be implemented with programming or scripting language such as C, C++, Java, assembler language, or the like, with the various algorithms being implemented with any combination of data structures, objects, processes, routines or other programming elements. Functional aspects may be implemented in algorithms that may be executed on one or more processors. Furthermore, the inventive concept could employ a number of conventional techniques for electronics configuration, signal processing and/or control, data processing and the like. The words "mechanism," "element," "means," and "configuration" are used broadly and are not limited to mechanical or physical embodiments, but may include software routines in conjunction with processors, etc.

The particular implementations shown and described herein are illustrative examples of the inventive concept and are not intended to otherwise limit the scope of the inventive concept. For the sake of brevity, conventional electronics, control systems, software development and other functional aspects of the systems may not be described in detail. Furthermore, the connecting lines, or connectors shown in the various figures presented are intended to represent exemplary functional relationships and/or physical or logical couplings between the various elements. It should be noted that alternative or additional functional relationships, physical connections or logical connections may be present in a practical device.

The use of the terms "a" and "an" and "the" and similar referents in the context of describing the inventive concept (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Also, the operations of all methods described herein can be performed in any suitable order unless otherwise indicated herein or otherwise clearly contradicted by context. The inventive concept is not limited to the described order of the operations. The use of examples, or exemplary language (e.g., "such as") provided herein, is intended merely to better illuminate the inventive concept and does not pose a limitation on the scope of the inventive concept unless otherwise claimed. Numerous modifications and adaptations will be apparent to one of ordinary skill in the art without departing from the spirit and scope of the inventive concept.

What is claimed is:

1. A method of controlling a fuser of an image forming apparatus, the method comprising:

applying power to the image forming apparatus; and controlling, by a fuser controller, the power applied to the image forming apparatus to be applied to the fuser until a main controller of the image forming apparatus completes a performing of an initialization, and controlling a temperature of the fuser according to a duty table having recorded thereon at least one duty value corresponding to life of the fuser.

2. An image forming apparatus comprising:

a fuser;

a main controller to perform an initialization of a first program including instructions that when executed control the fuser and at least one other component of the image forming apparatus; and a fuser controller connectable to at least one of the fuser and the main controller, the fuser controller including:

a memory to store a second program including instructions that when executed control a power supplied to the fuser, a processor:

to receive a temperature of the fuser during a time the main controller performs the initialization of the first program, to read the stored second program from the memory, and to execute the read second program to control, based on the received temperature of the fuser, the power supplied to the fuser during the time the main controller performs the initialization of the first program until the main controller completes the initialization of the first program, and a communication unit to transmit/receive data to/from the main controller.

3. The apparatus of claim 2, wherein the processor determines whether the temperature of the fuser exceeds a reference value and controls a power supply of the image forming apparatus to supply the power to the fuser only if the temperature of the fuser does not exceed the reference value.

4. The apparatus of claim 2, wherein when the main controller completes the initialization of the first program, the processor ends an operation thereof.

5. The apparatus of claim 2, further comprising:

a hardware protection circuit to control an on/off operation of the fuser, wherein the hardware protection circuit comprises a logic circuit outputting an on/off signal to a relay if the temperature of the fuser is equal to or less than a reference value by using a lookup-table.

6. The apparatus of claim 2, further comprising:

a software protection circuit to control an on/off operation of the fuser, wherein the software protection circuit comprises a logic circuit outputting an on/off signal to a photo coupler if the temperature of the fuser is equal to or less than a reference value by using a lookup-table.

7. The apparatus of claim 2, wherein the processor increases or decreases a duty of a signal controlling the fuser depending on the temperature of the fuser.

8. The apparatus of claim 2, wherein if the temperature of the fuser is equal to or greater than a set temperature, the processor blocks the power supplied to the fuser.

9. The apparatus of claim 2, wherein if the image forming apparatus operates in a save mode, the processor blocks the power supplied to the fuser.

10. The apparatus of claim 2, wherein the fuser controller further comprises:

an analog-to-digital converter (ADC) to receive an analog signal representing the temperature of the fuser from a thermistor and to convert the analog signal into a digital signal, and the processor receives the temperature of the fuser via the digital signal from the ADC and controls the power supplied to the fuser according to the received digital signal.

11. A method of controlling a fuser of an image forming apparatus, the method comprising:

applying power to the image forming apparatus;

in response to the applying of power, performing, by a main controller, an initialization of a program including instructions that when executed control the fuser and at least one other component of the image forming apparatus;

receiving, by a fuser controller, a temperature of the fuser during the performing of the initialization of the first program by the main controller; and controlling, by the fuser controller and based on the received temperature of the fuser, a power supplied to the fuser during the performing of the initialization of the first program by the main controller until the performing of the initialization of the first program by the main controller is completed.

12. An image forming apparatus comprising:

a fuser;

a main controller to perform an initialization; and a fuser controller connectable to at least one of the fuser and the main controller, wherein the fuser controller comprises:

a memory to store a program and a duty table having recorded thereon at least one duty value corresponding to a life of the fuser, a processor to read the stored program from the memory, to execute the read program to control power supplied to the fuser until the main controller completes the initialization, and to control a temperature of the fuser according to the stored duty table, and a communication unit to transmit/receive data to/from the main controller.

13. The method of claim 11, wherein the controlling, at the fuser controller, comprises:

increasing or decreasing a duty of a signal controlling the fuser depending on the temperature of the fuser.

14. The method of claim 11, wherein the controlling, by the fuser controller, comprises:

determining whether the temperature of the fuser exceeds a reference value, and controlling a power supply to supply power to the fuser only if the temperature of the fuser does not exceed the reference value.

15. The method of claim 11, further comprising, when the main controller completes the performing of the initialization, controlling the fuser by the main controller and ending, at the fuser controller, an operation thereof.

16. The method of claim 11, further comprising:

if the temperature of the fuser is equal to or less than a reference value, outputting, at a hardware protection circuit, an on/off signal to a relay by using a lookup-table.

17. The method of claim 11, further comprising:

if the temperature of the fuser is equal to or less than a reference value, outputting, at a software protection circuit, an on/off signal to a photo coupler by using a lookup-table.

18. The method of claim 11, wherein the controlling, at the fuser controller, comprises:

when the temperature of the fuser is equal to or greater than a set temperature, blocking power supplied to the fuser.

19. The method of claim 11, wherein the controlling, at the fuser controller, comprises:

when the image forming apparatus operates in a save mode, blocking power supplied to the fuser.

20. A non-transitory computer-readable recording medium having recorded thereon a program for executing the method of claim 11.

* * * * *